US007682218B2

(12) United States Patent
Yu et al.

(10) Patent No.: US 7,682,218 B2
(45) Date of Patent: Mar. 23, 2010

(54) TOY VEHICLE AND LAUNCHER

(75) Inventors: Glenn Yu, San Marino, CA (US); Kevin Cao, Reseda, CA (US); Bryan Benedict, St. Torrance, CA (US)

(73) Assignee: Mattel, Inc., El Segundo, CA (US)

( * ) Notice: Subject to any disclaimer, the term of this patent is extended or adjusted under 35 U.S.C. 154(b) by 653 days.

(21) Appl. No.: 11/525,247

(22) Filed: Sep. 20, 2006

(65) Prior Publication Data

US 2008/0070473 A1 Mar. 20, 2008

(51) Int. Cl.
*A63H 29/02* (2006.01)
*A63H 29/22* (2006.01)
*A63H 17/00* (2006.01)

(52) U.S. Cl. ..... 446/440; 446/424; 446/462

(58) Field of Classification Search ..... 446/78, 446/269, 275, 279–288, 380, 381, 391, 424, 446/429, 440, 444, 462, 448, 449, 450, 451, 446/453, 465, 469
See application file for complete search history.

(56) References Cited

U.S. PATENT DOCUMENTS

| | | | | |
|---|---|---|---|---|
| 3,605,334 | A | 5/1969 | Genin | |
| 3,798,832 | A * | 3/1974 | Terzian | 446/429 |
| 3,803,756 | A | 4/1974 | Strongin | |
| 3,886,682 | A * | 6/1975 | Ieda et al. | 446/429 |
| 3,895,458 | A | 7/1975 | Lemelson | |
| 3,908,303 | A | 9/1975 | McKay et al. | |
| 4,016,674 | A * | 4/1977 | Resnick et al. | 446/409 |
| 4,260,041 | A | 4/1981 | Mabuchi | |
| 4,269,596 | A | 5/1981 | D'Andrade | |
| 4,358,104 | A | 11/1982 | Rivette et al. | |
| 4,363,186 | A | 12/1982 | Goldfarb et al. | |
| 4,421,485 | A | 12/1983 | Geschwender | |
| 4,423,871 | A * | 1/1984 | Mucaro | 463/64 |
| 4,479,326 | A | 10/1984 | Kennedy et al. | |
| 4,531,751 | A | 7/1985 | Todokoro | |
| 4,541,813 | A * | 9/1985 | Ikeda | 446/424 |
| 4,573,936 | A | 3/1986 | Wolf | |
| 4,715,602 | A * | 12/1987 | May et al. | 463/60 |
| 4,932,913 | A | 6/1990 | Raviv et al. | |
| 5,052,973 | A * | 10/1991 | Rudell et al. | 446/429 |
| 5,127,658 | A | 7/1992 | Openiano | |
| 5,141,468 | A | 8/1992 | Suzuki | |
| 5,344,354 | A | 9/1994 | Wiley | |
| 5,480,333 | A | 1/1996 | Larson | |
| 5,823,848 | A | 10/1998 | Cummings | |
| 6,461,238 | B1 | 10/2002 | Rehkemper et al. | |
| 6,517,408 | B1 * | 2/2003 | Rehkemper et al. | 446/462 |
| 2006/0160464 | A1 | 7/2006 | Vetuskey | |

FOREIGN PATENT DOCUMENTS

| | | | |
|---|---|---|---|
| FR | 2549382 | A1 | 1/1985 |
| WO | WO 0168211 | A1 * | 9/2001 |

* cited by examiner

*Primary Examiner*—Nini Legesse
(74) *Attorney, Agent, or Firm*—Edell, Shapiro & Finnan, LLC

(57) ABSTRACT

A toy vehicle set. The toy vehicle set includes a toy vehicle including a steering mechanism, and a toy launcher to selectively energize the toy vehicle for movement while selectively securing the toy vehicle in a fixed position. The toy launcher looks approximately the same as the steering mechanism of the toy vehicle.

14 Claims, 2 Drawing Sheets

Fig. 2
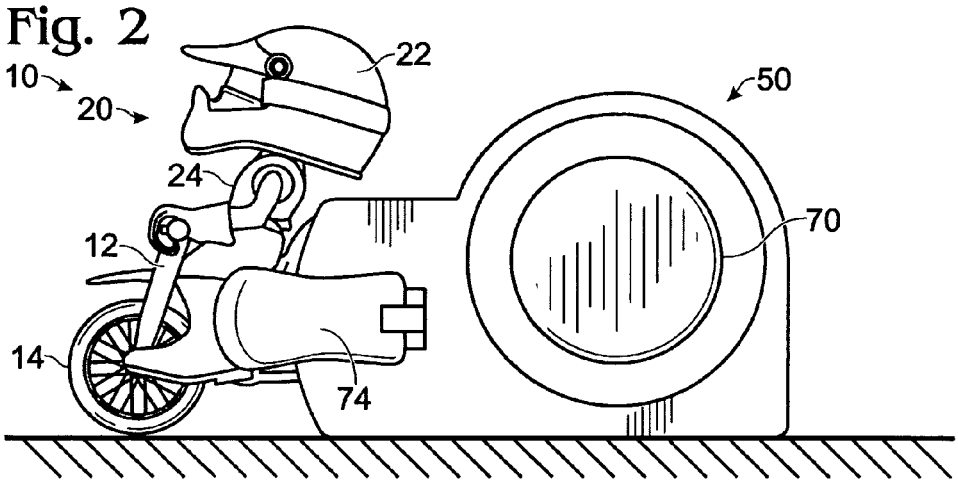
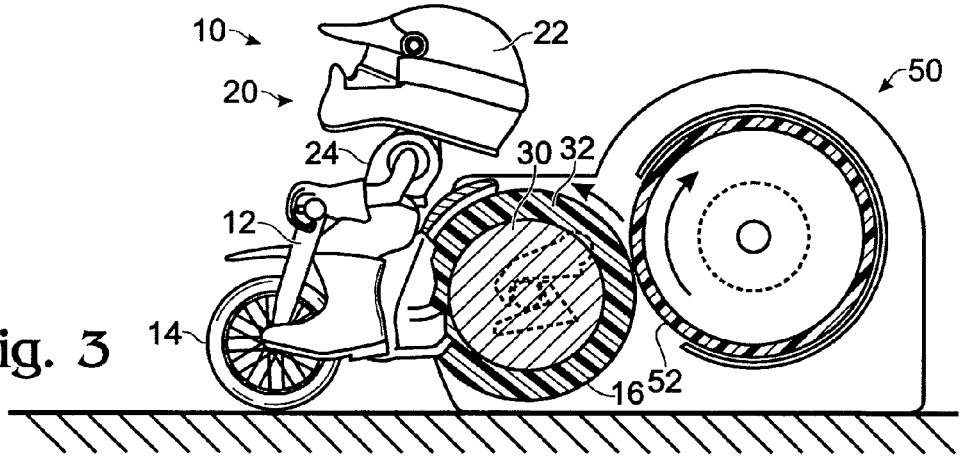
Fig. 3
Fig. 4
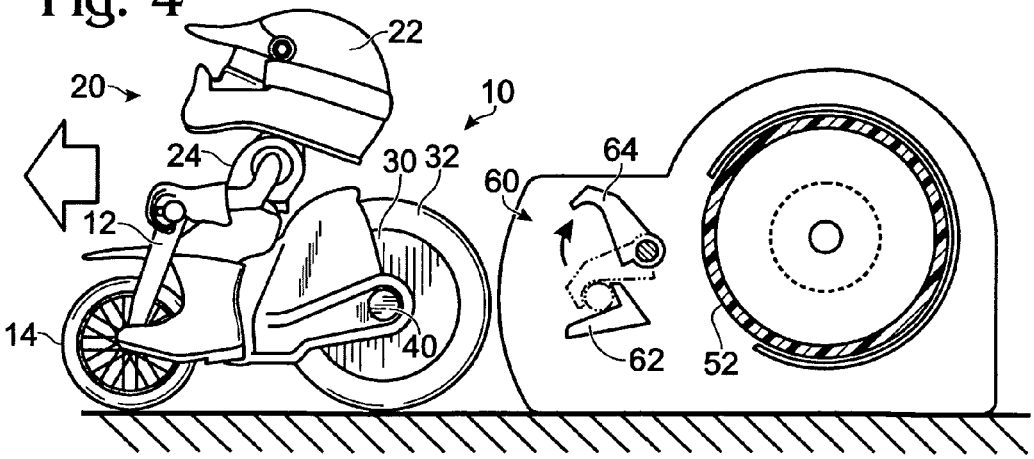

TOY VEHICLE AND LAUNCHER

BACKGROUND AND SUMMARY

Toy vehicles have proven to be popular amongst children and adult collectors. However, because of the enormous variety of toy vehicles that are available to consumers, it is increasingly important to differentiate other vehicles in order to attract consumer attention.

One method of attracting consumer attention is to equip toy vehicles with driving functionality. In the past, some toy cars have been propelled by a launcher that shoots the vehicle from the launcher at high speed.

The inventor herein has recognized that in addition to propelling a vehicle, a launcher can help form a physical bond between the toy vehicle and the user. In particular, the inventor herein has recognized a benefit in designing a toy launcher that at least partially mimics the controls of the corresponding toy vehicle.

BRIEF DESCRIPTION OF THE DRAWINGS

FIG. 2 shows a side view of the toy motorcycle and toy launcher of FIG. 1.

FIG. 3 shows a partially cut away side view of the toy motorcycle and toy launcher of FIG. 1, with the toy motorcycle being energized by the toy launcher.

FIG. 4 shows a partially cut away side view of the toy motorcycle and toy launcher of FIG. 1, with the toy motorcycle being released and rolling away from the toy launcher.

WRITTEN DESCRIPTION

Figure 1:
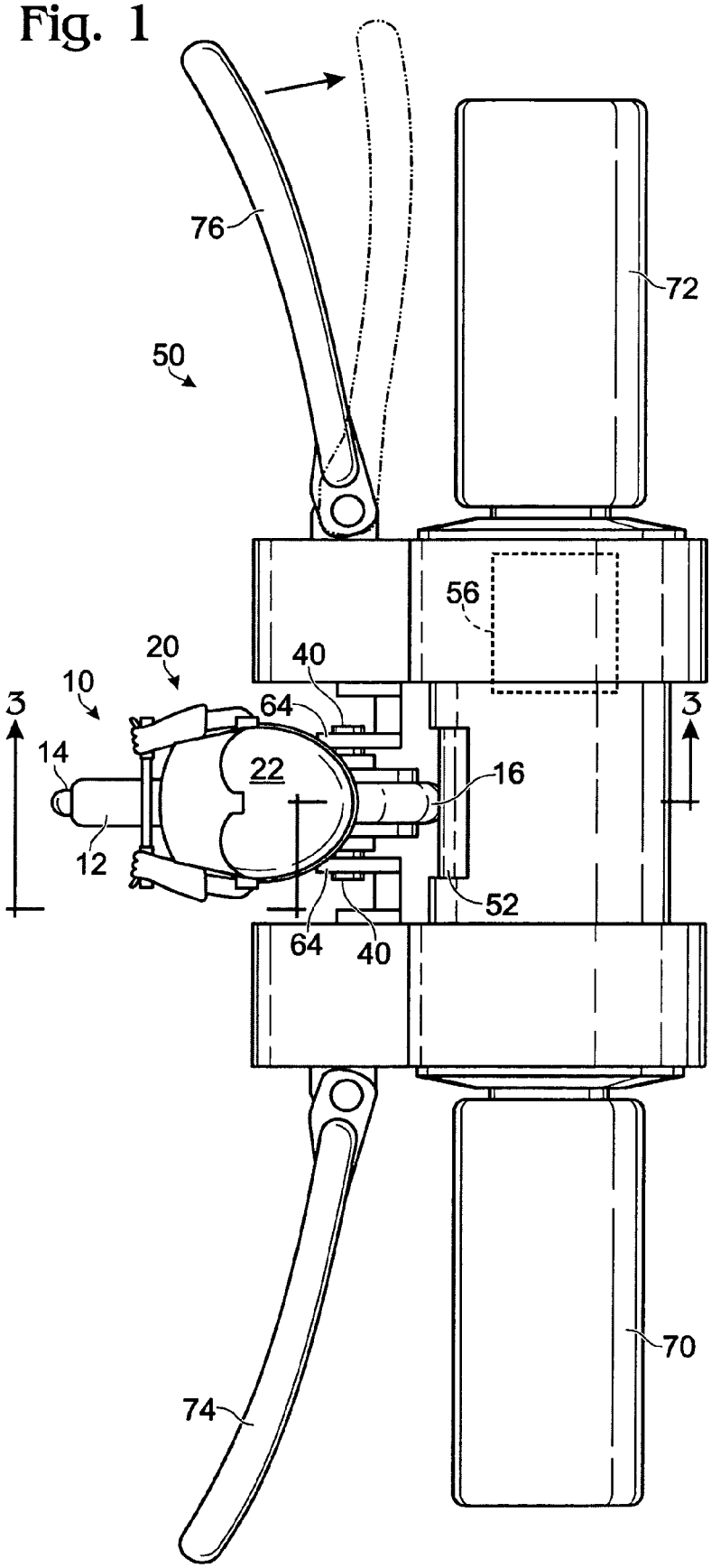
FIG. 1 shows a top view of a toy motorcycle and toy launcher in accordance with an embodiment of the present disclosure.

The present disclosure is directed to a toy vehicle and a launcher for energizing the vehicle and causing it to roll away from the launcher. The appearance of the vehicle and the launcher can be selected to appeal to a particular target audience. As an example, the inventors recognize that the play value of the toys can be increased if the launcher is made to resemble real vehicle controls. Accordingly, an example toy motorcycle and a toy motorcycle launcher are described below. The toy motorcycle launcher is designed to resemble a real motorcycle handlebar control. Of course, various aspects of the below described example can be modified without departing from the spirit and the scope of this disclosure, and such modifications should be considered part of this disclosure.

FIGS. 1-4 show a nonlimiting example of a toy motorcycle 10 and a toy motorcycle launcher 50. In the illustrated embodiment, toy motorcycle 10 includes a frame 12, a front wheel 14, and a rear wheel 16. The front and rear wheels are spinably coupled to the frame, thus allowing the motorcycle to roll. In the illustrated embodiment, the front wheel is substantially smaller than the rear wheel. In other embodiments, the wheels may be approximately the same size, or the front wheel can be larger than the rear wheel.

A rider 20 is designed to straddle the motorcycle frame. In the illustrated embodiment, rider 20 is not separable from the motorcycle frame. In other embodiments, the rider may be removed from the frame. In some embodiments, the toy will not include a rider.

Rider 20 has a basic humanoid shape but with several exaggerated features. For example, rider 20 includes a head 22 that is relatively large when compared to a torso 24. In the illustrated embodiment, head 22 includes a full-faced helmet and goggles, and torso 24 includes a race suit. The particular look of a rider's costume can be selected to help emphasize a desired theme. For example, the illustrated embodiment conjures a motocross race theme, as emphasized by the motocross helmet, goggles, and race suit. Because the helmet is important in evoking the motocross race theme, it adds dramatic effect to increase the size of the helmet relative to the rest of the torso. While exaggerated features can increase the desirability of the toy for many users, some users prefer realistically scaled features, and thus a rider can be provided without exaggerated features.

A rider's costume can be integrated into the rider's body, or one or more aspects of the costume can be removable. When removable, such aspects of the costume can be interchanged with other costume parts. For example, two or more different helmets may be compatible with a toy rider, and a user may select with which helmet to equip the rider. In such embodiments, a helmet may come off of the rider's head, or the head and helmet may be removed from the rider's shoulders and replaced as a whole. In some embodiments, other costume aspects such as gloves, boots, suit, and/or goggles can be interchangeable.

In some embodiments the rider can be fixed in a static riding position, while in other embodiments the rider may include one or more joints so that the position of the rider can be changed during play. In some embodiments, the rider may include a flexible neck joint that allows the rider's head to oscillate or bobble.

The relatively large size of a rider's head and/or other body parts can raise the center of gravity for the toy. Raising the center of gravity can make the toy easier to tip over, which may not be desirable. Accordingly, one or more aspects of a rider and/or a motorcycle can be designed to help lower the toy's center of gravity. As an example, a rider's head/helmet may be made from a relatively light material, such as plastic. Furthermore, the rider may include parts that include one or more air pockets or other breaks in solid material to help limit weight. For example, the rider's helmet may be substantially hollow, thus decreasing weight.

In addition to lowering a toys center of gravity, the motorcycle can be stabilized by one or more gyroscopic flywheels. As used herein, a gyroscopic flywheel is a ring, disk, or other object that can rotate relative to the frame of the motorcycle. When rotating, the gyroscopic flywheel has an angular momentum that will be conserved. In other words, the gyroscopic flywheel can help prevent the motorcycle from tipping over and/or turning. By increasing the weight of the gyroscopic flywheel, especially near the perimeter of the flywheel, the moment of inertia for the flywheel can be increased, thus enhancing the stabilizing characteristics of the flywheel. Furthermore, if the gyroscopic flywheel is positioned relatively low, the increased weight of the flywheel can help lower the toy's center of gravity, further stabilizing the toy.

In the illustrated embodiment, a gyroscopic flywheel 30 is formed as part of rear wheel 16. In particular, rear wheel 16 includes a tire portion 32 that is configured to roll on the ground. Gyroscopic flywheel 30 is positioned interior the tire portion. As mentioned above, rear wheel 16 can be relatively large compared to the front wheel. This allows for a relatively large gyroscopic flywheel to be formed in the rear wheel. Furthermore, the moment of inertia of the flywheel can be increased by increasing the width of the flywheel (i.e., making it thicker). The moment of inertia can also be increased by constructing the flywheel out of a relatively dense material, such as a metal.

While not shown in the illustrated embodiment, the toy motorcycle can include one or more alternative and/or additional flywheels, other than a rear wheel flywheel. For example, the toy motorcycle can include a front wheel flywheel. A flywheel may also be located apart from the wheels, for examples as an internally spinning flywheel that is part of the motorcycle frame or the rider. When a flywheel that is not part of the wheels is included, such a flywheel can optionally be mechanically linked to the wheels, so that rolling energy can be transferred from the flywheel to the rolling wheels.

A gyroscopic flywheel can be orientated so as to rotate in the same direction as at least the rear wheel, although this is not necessarily required in all embodiments. In some embodiments, the motorcycle can include two or more gyroscopic flywheels. When two or more flywheels are present, both flywheels can be orientated in the same direction (e.g., in-line or side-by-side) or the flywheels can have a different orientation. For example, one flywheel may have a rotating axis that is parallel to the rear wheel's rotating axis, while another flywheel has a rotating axis that is substantially perpendicular to the rear wheel's rotating axis, extending substantially straight up and down.

A motorcycle launcher 50 can optionally be used to energize toy motorcycle 10. In the illustrated embodiment, launcher 50 is designed to spin rear wheel 16 while that wheel is supported above the ground. By spinning up the rear wheel, a substantial amount of energy can be stored in gyroscopic flywheel 30. As shown in FIG. 4, once the wheel is spun up, the motorcycle can be released from the launcher, and the energy stored in the flywheel can be used to roll the motorcycle wheels, thus causing the motorcycle to travel forward on the ground or another surface. The faster the flywheel is spun up, the faster and/or farther the motorcycle can travel.

The illustrated launcher 50 includes roller or energizer 52 for spinning up the gyroscopic flywheel. Roller 52 is designed to contact tire portion 32 of rear wheel 16. As a result, the energizer selectively spins the rear wheel 16 of the toy motorcycle 10. Roller 52 is operatively connected to an electric motor 56 that spins the roller. The roller can be constructed out of a variety of different materials, depending on desired performance characteristics. In some embodiments, the roller can include a metal surface, which provides a long wearing surface with favorable heat dissipation characteristics. In some embodiments, the roller can include a plastic or rubber surface, which provides good traction. Other materials may alternatively be used. An energizer activator selectively causes the energizer to spin the rear motorcycle wheel. The energizer activator is accessible by a hand gripping the left handlebar grip or the right handlebar grip (discussed in greater detail below).

Launcher 50 includes a motor for spinning roller 52. The motor can be an electric motor that is powered by batteries, AC power received via a power cord, or via another suitable source. In some embodiments, the motor can be user powered, such as via a hand crank, rip cord, or other suitable source.

Launcher 50 also includes a release assembly 60 that holds the toy motorcycle in position for the roller to spin up the rear wheel, and then releases the motorcycle so that it can travel away from the launcher. In the illustrated embodiment, motorcycle 10 includes pegs 40 that are configured to be held by release assembly 60. The pegs 40, which extend laterally from the motorcycle and are aligned with a rotating axis of the rear wheel 16, are adapted to engage a ramp and support the rear wheel above a ground surface. In particular, the release assembly includes a ramp 62 that pegs 40 can slide up when the motorcycle is backed into the launcher. The ramp engages the pegs and lifts the rear wheel off the ground and into contact with roller 52. The release assembly also includes a catch 64 that can selectively engage pegs 40 when they are backed onto ramp 62. In this way, the motorcycle can be secured in a position in which the rear wheel is in contact with the roller while being lifted off of the ground. As such, the roller can spin up the rear wheel. Once the rear wheel is spun up, catch 64 can be adjusted to release the pegs, thereby allowing the pegs to slide forward off of the ramp until the spun up rear wheel contacts the ground and drives the motorcycle away from the launcher. A release activator engages the release assembly and selectively allows the motorcycle to move from its fixed position. The release activator may be accessible via a hand gripping the right handlebar grip 72 or the left handlebar grip 74 (discussed in greater detail below).

The above described rolling mechanism and release assembly are nonlimiting examples of the mechanisms that can be used to launch the toy motorcycle. In other embodiments, energy may be transferred to the motorcycle via a gear arrangement that turns a flywheel in the motorcycle. This arrangement may be particularly useful for embodiments in which the flywheel is not part of the rear wheel. In other embodiments, a changing magnetic field can be used to spin up a flywheel. In still other embodiments, the motorcycle may include a motor for spinning the flywheel, and the launcher can be used to deliver power to the motor.

In the illustrated embodiment, launcher 50 is designed to resemble a motorcycle handlebar. This can increase the desirability of the toy for children who want to make-believe that they are controlling a real motorcycle. To help enhance the fantasy of controlling a real motorcycle, launcher 50 includes left grip 70 on the left side of the launcher and right grip 72 on the right side of the launcher. The grips are designed so that a child (or other user playing with the toy) can hold the grips just as they would hold grips on a full-sized motorcycle handlebar. When holding the grips in the manner, the toy motorcycle is positioned substantially between the left and right hands of the user. A left lever 74 is positioned for operation by the left hand while holding the left grip and a right lever 76 is positioned for operation by the right hand while holding the right grip. The left and right levers resemble brake or clutch levers on a full-sized motorcycle. Furthermore, one or more of the grips may optionally be twistable, thus mimicking the throttling action of a full-sized motorcycle grip. A selected subset of the above described handlebar features can be included in various embodiments of a motorcycle launcher, and/or additional controls can be added (e.g., a thumb-operated throttle, display instruments, light switches, blinker switches, etc.).

The various handlebar controls can be used to control operation of the launcher. For example, in the illustrated embodiment a twisting of the right grip causes roller 52 to spin up the rear wheel. In other words, the right grip functions as an energizer activator, activating the roller. Furthermore, in the illustrated embodiment, the right lever functions as the release activator, activating the release mechanism, and allowing the toy motorcycle to leave the launcher once the rear wheel is spun up. The above described controls are nonlimiting examples. In other embodiments, the left lever may activate the release mechanism, one of the levers may activate the roller, the release mechanism may be automatically activated once the wheel is spun up, etc. In some embodiments, the launcher may come with a key that must be turned on to activate the roller.

In the illustrated embodiment, the left grip and the right grip are spaced closely together. In other embodiments, the grips may be spaced further apart. In some embodiments, grip spacing may be selectively changed. For example, the grips can be spaced close together for storage and travel, but spread apart for use while playing.

While a motorcycle launcher in the form of motorcycle handlebars is described above, it should be understood that a similar concept can be adapted for use with different types of toys. For example, a launcher in the form of a steering wheel can be used to launch a car or truck, a launcher in the form of a periscope could be used to launch a bathtub toy submarine, a launcher in the form of a pilot's control stick could be used to launch a toy airplane, glider, or helicopter, etc. As such, the above described vehicle and launcher can be adapted in accordance with a desired theme.

The invention claimed is:

1. A launcher for a toy motorcycle having a front wheel and a rear wheel, the motorcycle including a laterally extending peg, the launcher comprising:

a launch body including:

a release assembly to selectively secure the toy motorcycle in a fixed position, the release assembly including:

an inclined ramp operable support the rear wheel such that the rear wheel is lifted off a surface, and a pivoting catch that selectively engages the peg on the motorcycle to secure the rear wheel to the ramp; and an energizer configured to spin the rear wheel of the toy motorcycle;

a left handlebar grip operatively coupled to a left side of the launch body;

a right handlebar grip operatively coupled to a right side of the launch body;

an energizer activator selectively causing the energizer to spin the rear motorcycle wheel; and a release activator configured to activate the release assembly, selectively allowing the motorcycle to move from the fixed position by disengaging the catch and permitting the rear wheel to slide off of the ramp and contact the surface.

2. The launcher of claim 1, wherein:

one of the handlebar grips includes the energizer activator; and twisting the one of the handlebar grips engages the energizer activator and spins the rear wheel.

3. The launcher of claim 2, wherein the energizer comprises a roller to contact the rear wheel of the toy motorcycle when the toy motorcycle is secured in the fixed position.

4. The launcher of claim 3, wherein:

the peg is aligned with a rotating axis of the rear wheel;

the catch captures the peg to the ramp;

the release activator comprises a lever coupled to one of the handlebar grips; and engaging the lever pivots the catch to disengage the peg and release the rear wheel of the motorcycle.

5. A toy vehicle set comprising:

a toy vehicle operable to travel along a surface, the vehicle comprising:

a steering mechanism, a front wheel, a rear wheel having a wheel rotational axis, and pegs extending laterally from the rear wheel, the pegs being aligned with the rotational axis of the rear wheel; and a toy launcher configured to launch the toy along the surface, the toy launcher comprising:

a roller to selectively energize the toy vehicle for movement; and a release assembly including:

ramps configured to engage the pegs of the rear wheel and support the rear wheel above the surface, and a catch to selectively capture the pegs to the ramps and to position the rear wheel in contact with the roller.

6. The toy vehicle set of claim 5, wherein:

the toy vehicle is a toy motorcycle; and the rear wheel comprises a gyroscopic flywheel operable to store rotational energy.

7. The toy vehicle set of claim 6, wherein the toy launcher further includes a left handlebar lever and a right handlebar lever.

8. The toy vehicle set of claim 7, wherein the left handlebar lever or the right handlebar lever launches the toy motorcycle from the launcher.

9. The toy vehicle set of claim 6, wherein the toy motorcycle includes a rider in a riding position on the toy motorcycle.

10. The toy vehicle set of claim 5, wherein:

the ramps are inclined toward the surface.

11. A toy vehicle set comprising:

a toy vehicle including:

a front wheel and a rear wheel, the rear wheel comprising a tire portion and a gyroscopic flywheel, the rear wheel including a rotational axis, and pegs extending laterally from the rear wheel, the pegs being aligned with the rotational axis of the rear wheel; and a launching device operable to energize the toy vehicle such that the toy vehicle travels along a travel surface, the launching device comprising:

ramps configured to support the pegs, each of the ramps having a ramp surface inclined toward the travel surface, a roller operable to spin the rear wheel and energize the flywheel, catches operable to capture the pegs of the rear wheel to the ramps and position the rear wheel in contact with the roller, and a release mechanism to release the pegs, wherein, upon release of the pegs, the pegs slide off the ramps and the rear wheel contacts the travel surface.

12. The toy vehicle set of claim 11, wherein:

the rear wheel includes a first side and a second side;

one of the pegs extends laterally from the first side of the rear wheel; and the other of the pegs extends laterally from the second side of the rear wheel.

13. The toy vehicle set of claim 11, wherein:

each of catches pivots with respect to one of the ramps;

the release mechanism includes a release lever; and engaging the release lever pivots catches.

14. The toy vehicle set of claim 11, wherein the front wheel of the vehicle contacts the travel surface while the flywheel is energized.

* * * * *